US005950917A

United States Patent [19]

Smith

[11] Patent Number: 5,950,917

[45] **Date of Patent: *Sep. 14, 1999**

[54] DUAL WALL INSULATED CONTAINER AND METHOD FOR MAKING THE SAME

[75] Inventor: Ernest L. Smith, Kansas City, Mo.

[73] Assignee: Sealright Co., Inc., DeSoto, Kans.

[ * ] Notice: This patent issued on a continued prosecution application filed under 37 CFR 1.53(d), and is subject to the twenty year patent term provisions of 35 U.S.C. 154(a)(2).

[21] Appl. No.: 08/892,422

[22] Filed: Jul. 14, 1997

[51] Int. Cl.[6] ..... B65D 3/00

[52] U.S. Cl. ..... 229/403; 220/903; 229/4.5; 229/5.5

[58] Field of Search ..... 215/12.1, 12.2, 215/382, 13.1; 229/400, 403, 120, 4.5, 5.5; 220/415, 418, 420, 425, 421, 120, 903

[56] References Cited

U.S. PATENT DOCUMENTS

| | | | |
|---|---|---|---|
| 549,394 | 11/1895 | Presnell . | |
| 1,173,284 | 2/1916 | Leiman . | |
| 1,733,674 | 10/1929 | Schleicher . | |
| 2,028,566 | 1/1936 | Seipel et al. . | |
| 2,192,415 | 3/1940 | Schwarzenzer . | |
| 2,266,828 | 12/1941 | Sykes | 229/403 X |
| 3,049,277 | 8/1962 | Shappell | 229/403 |
| 3,445,049 | 5/1969 | Carpenter, Jr. . | |
| 3,642,967 | 2/1972 | Doll | 229/400 X |
| 3,921,897 | 11/1975 | Noyes et al. | 229/4.5 X |
| 4,288,026 | 9/1981 | Wilhelm | 229/400 |
| 4,548,349 | 10/1985 | Tunberg . | |
| 4,928,848 | 5/1990 | Ballway . | |
| 5,205,473 | 4/1993 | Coffin, Sr. . | |
| 5,226,585 | 7/1993 | Varano . | |
| 5,454,484 | 10/1995 | Chelossi . | |
| 5,460,323 | 10/1995 | Titus . | |
| 5,469,983 | 11/1995 | Yawata | 229/403 X |
| 5,547,124 | 8/1996 | Mueller | 229/403 |
| 5,667,135 | 9/1997 | Schaefer | 229/403 |
| 5,685,480 | 11/1997 | Choi | 229/403 |
| 5,775,577 | 7/1998 | Titus | 229/403 |

*Primary Examiner*—Gary E. Elkins
*Assistant Examiner*—Tri M. Mai
*Attorney, Agent, or Firm*—Shook, Hardy & Bacon LLP

[57] ABSTRACT

A dual wall container formed of a laminated blank wrapped about the longitudinal axis of the container to define a inner sidewall and an outer sidewall. The laminated blank comprises an inner sheet affixed to an outer sheet, wherein expansion joints may be provided on the outer sheet to enable the same to increase in circumference as the container is formed. Preferably, scores are provided within the inner sheet so as to form annular air pockets extending circumferentially around the container between the inner and outer sidewalls for uniform insulation.

20 Claims, 3 Drawing Sheets

DUAL WALL INSULATED CONTAINER AND METHOD FOR MAKING THE SAME

BACKGROUND OF THE INVENTION

1. Field of the Invention

The present invention is directed to disposable insulated containers such as beverage cups and is more specifically directed to a dual wall container constructed from a laminated blank.

2. Description of Related Art

It is well known in the art to provide containers made from plastic or foam materials for handling hot liquids such as hot beverages, soup, and the like. These type of containers are used in large quantities in the fast food and other industries requiring disposable containers. The plastic or foam material used to make these containers provides good insulating characteristics, maintaining the beverage hot while protecting the user's hands from the heat. However one drawback to the use of these containers, and particularly foam plastic containers is that they are not biodegradable and easily disposed. Recent social and legislative trends have created a need for improved disposable containers which are both recyclable and biodegradable while maintaining desirable insulating characteristics.

In an effort to obtain this goal, it has been known to provide disposable paper containers with some form of insulating cover or sleeve. For example, it is known to provide a paper container having a paper sidewall and an outer covering or sleeve of corrugated material. (See e.g., U.S. Pat. No. 2,028,566 to Seipel et al., U.S. Pat. No. 5,205,473 to Coffin, and U.S. Pat. No. 5,226,585 to Varano). The corrugated material has a furrowed outer surface characterized by continuous curved ridges and hollows extending vertically from the bottom to the top of the container. The air contained within these hollows serves to insulate the contents of the container. While these corrugated coverings are useful, the air within the hollows heated by convection of the hot liquid tends to continuously rise within the hollows above the fluid level such that the heat is dissipated away from the hot liquid. This convection process continuously repeats itself thereby cooling the contents of the cup and negating the insulating characteristics of the hollows.

It is also noted that the outer corrugated surface of these insulating sleeves is not well suited to include printed indicia such as the product name, graphics and logos, directions for use, ingredient lists, and nutritional information. The exposed corrugations may likewise be easily damaged or crushed by ordinary handling. Lastly, the cost and effort associated with the manufacture of these sleeves can be relatively high because a substantial quantity of paper is required to make the corrugated outer sleeve, a relatively large quantity of adhesive is required to secure all of the corrugations to the surface of the sidewall, and the container and the sleeve must be formed separately on different machines.

Another type of disposable insulated paper container known in the art includes the container disclosed in U.S. Pat. No. 5,460,323 to Titus which is a dual sidewall container having an uncorrugated outer wall and an inwardly bowed inner wall. The bowed inner wall defines an insulating air chamber extending around the container between the two walls. While this container provides a smooth outer surface for indicia, the single insulating air chamber extends vertically from an upper to a lower extent of the container such that heated air tends to rise above the fluid level such that the insulating properties are not uniform throughout the container. Lastly, this container requires the production of two separate sidewalls formed on different container forming machines, which must then be secured together.

Thus, providing an insulated paper container with an outer surface adapted to include printed indicia is desirable to enhance the marketability and the information conveying capability of the container. It is also desirable to enhance the insulation properties of the container by reducing the influence of convection currents and providing uniform insulation throughout the container. It is also desirable to reduce the amount of adhesive required to fabricate the containers, and to eliminate the use of multiple container forming machines and steps in the production process.

SUMMARY OF THE INVENTION

These and other objectives are achieved by a dual wall insulated container body having a closed bottom and an open top, wherein the container is formed from a laminated blank that is wrapped about the longitudinal axis of the container to provide an inner sidewall and an outer sidewall. By providing the sidewall blank as a dual wall laminate, the containers are manufactured quickly by one container forming machine.

The laminated blank is formed by securing an outer sheet which defines the outer sidewall of the container to an inner sheet which defines the inner sidewall of the container. The sheets are connected with adhesives, preferably applied proximate to end edges of the outer sheet. The laminated blank may then be wrapped about a container forming mandrel as is well known in the art with the ends of the blank being sealed in overlapping relationship to form a side seam. The outer sheet preferably includes expansion joints comprised of vertical slits to allow the outer sheet to expand and increase in circumference as the blank is formed into the container. A bottom piece may then be secured to the bottom edge of the inner sidewall blank to close the bottom of the container.

In a first embodiment of the invention, the inner sidewall of the container preferably includes a plurality of annular ribs spaced apart along a portion of the wall height and extending circumferentially around the inner sidewall. These annular ribs define annular air pockets between the inner sidewall and the outer sidewall which serve to insulate the contents of the container. Since the closed pockets extend circumferentially around the container, the heated air is more equally and uniformly spaced within these pockets along the height of the container. Insofar as the ribs are formed on the inner sidewall, the outer sidewall presents a substantially smooth surface particularly adaptable to receive printed indicia thereon. In this embodiment, the inner and outer sidewalls may be manufactured from paper which is recyclable and biodegradable.

In a second embodiment, the outer sidewall may be formed of styrofoam or other like material so as to provide uniform insulation around the container. In this embodiment, the styrofoam provides sufficient insulation as to eliminate the need for the annular ribs and air pockets. If the styrofoam material has sufficient elasticity characteristics, the outer sidewall may similarly not require the expansion joints.

BRIEF DESCRIPTION OF THE DRAWINGS

These and other features, advantages, and objects will appear from the following Detailed Description when considered in connection with the accompanying drawings in which similar reference characters denote similar elements throughout the several views and wherein.

DETAIL DESCRIPTION

Figure 2:
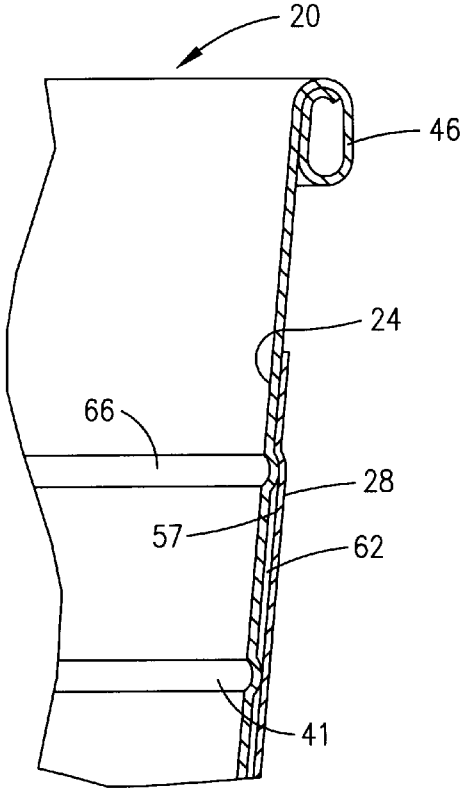
FIG. 2 is an enlarged fragmentary cross-sectional view of the region denoted by numeral 2 in FIG. 1.
Figure 1:
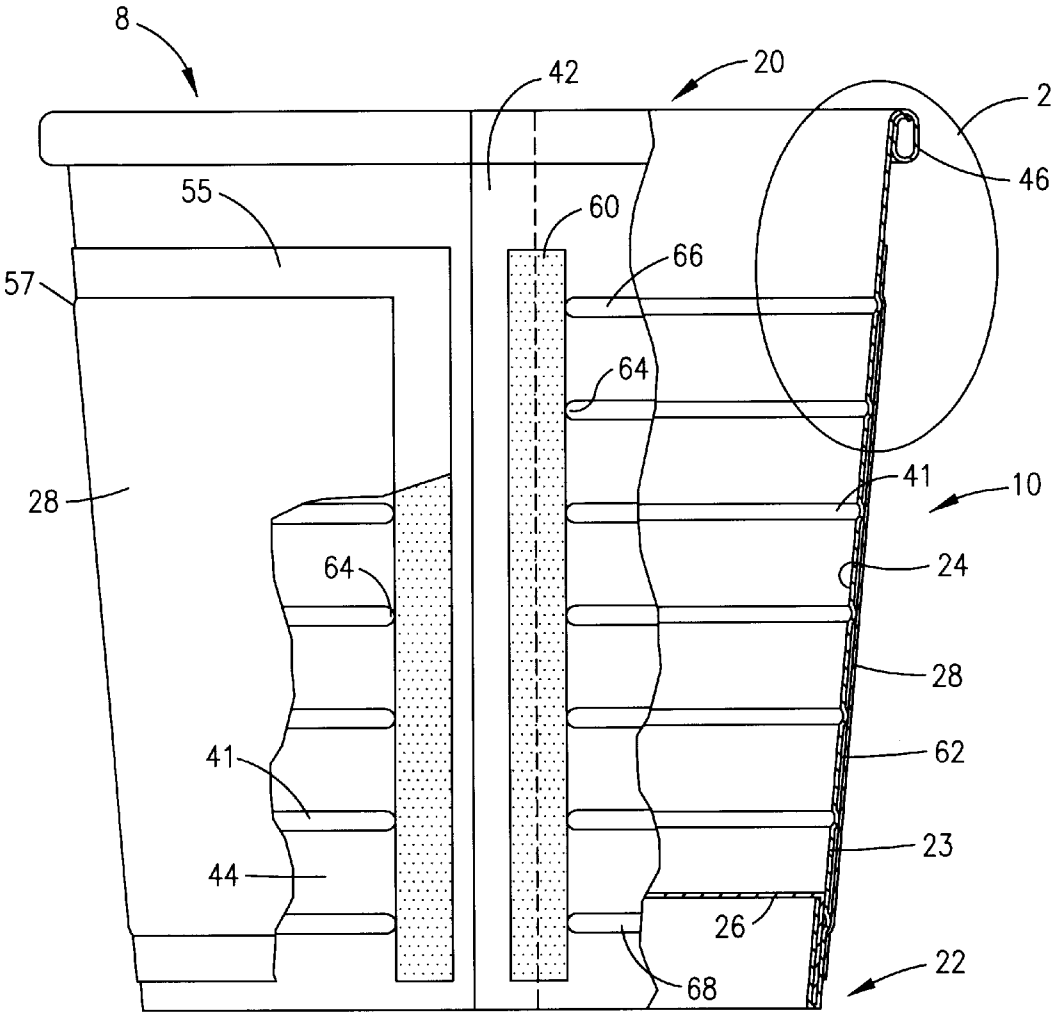
FIG. 1 is an elevational view in partial cross-section of a dual wall insulated container according to the first embodiment of the present invention having portions of the outer sidewall removed for purposes of illustration.

FIGS. 1 and 2 show a dual wall insulated container generally designated by the numeral 8. Container 8 has a frustoconical shaped body 10 which is open at its top 20 and has a closed bottom 22. Container body 10 is made from a laminated blank 23 wrapped about the longitudinal axis of the container to form an inner sidewall 24 and an outer sidewall 28. The blank 23 is secured along the ends to form a side seam 42.

Figure 5:
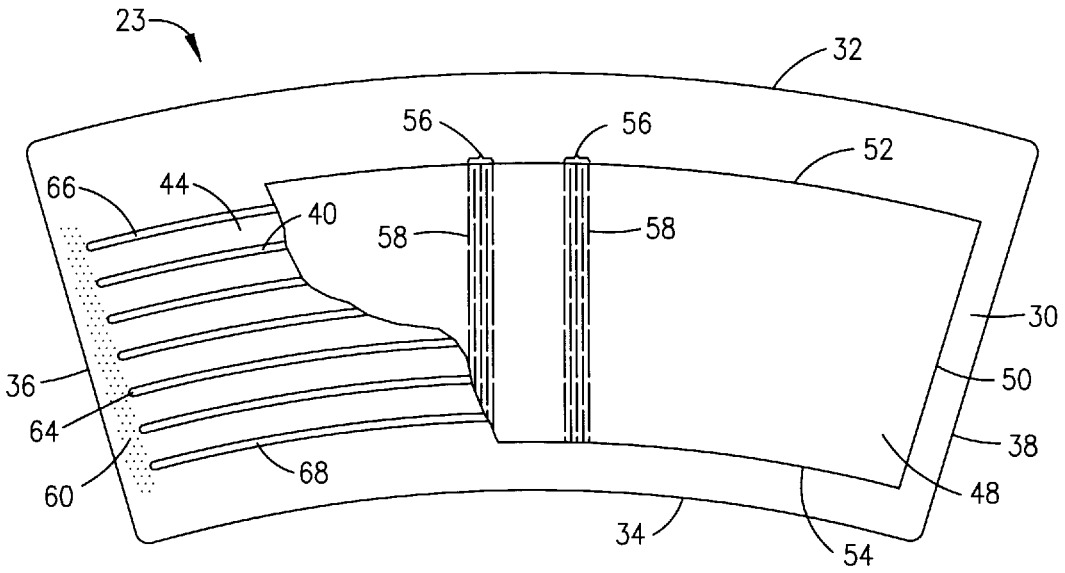
FIG. 5 is an elevational view of the laminated blank used to make the container of FIG. 1 prior to formation of the container and having a portion of the outer sidewall removed for purposes of illustration.
Figure 6:
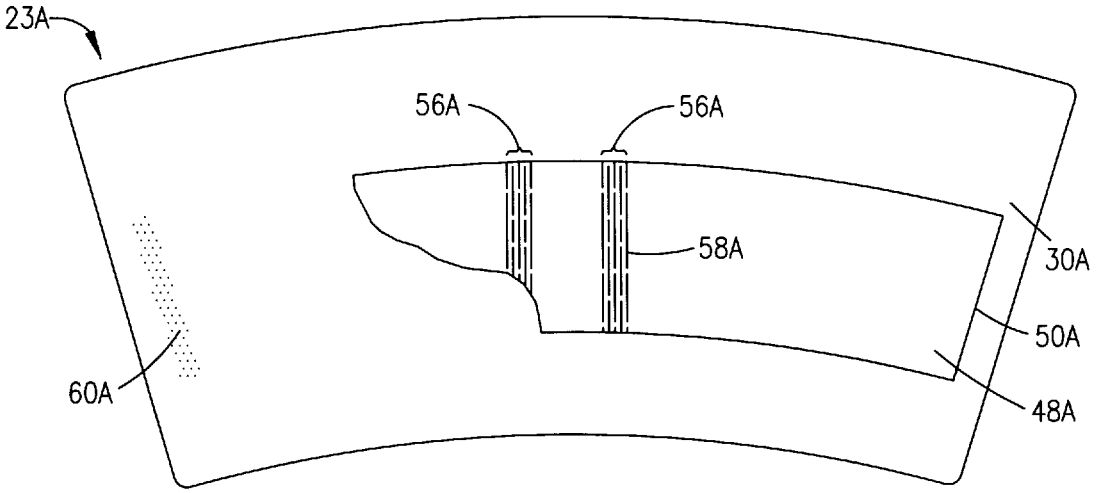
FIG. 6 is an elevational view of the laminated blank used to make the container of FIG. 3 prior to formation of the container and having a portion of the outer sidewall removed for purposes of illustration.

Looking to FIGS. 5 and 6, the laminated blank 23 has an inner sheet 30 which defines inner sidewall 24 and an outer sheet 48 which defines outer sidewall 28. A conventional bottom piece 26 is second to the bottom of body 10 preferably to the inner sidewall 24 to form closed bottom 22. The bottom piece and other conventional features will be discussed only to the extent necessary for a complete understanding of the invention.

Inner sidewall 24 is preferably made from paper and has a height extending between the closed bottom and the open top. Referring to FIG. 5, the inner sidewall is formed by inner sheet 30 having a top edge 32, a bottom edge 34, and two ends 36 and 38. Ends 36 and 38 are wrapped toward one another and overlap to form side seam 42 when blank 23 is formed into the shape of the container body. Inner sheet 30 is configured such that the top edge 32 and bottom edge 34 form arcs between ends 36 and 38, such that inner sheet 30 is essentially arcuate in shape.

In a first embodiment of the invention shown in FIG. 5, inner sheet 30 includes a plurality of scores 40 which extend parallel arced top and bottom edges 32 and 34. Looking to FIGS. 1 and 2, scores 40 form annular ribs 41 extending circumferentially around the container when container body 10 is formed. Ribs 41 do not extend completely around the container body but instead terminate in ends 64 which are spaced apart on opposite sides of side seam 42 at which the overlapping ends 36 and 38 of the inner sheet are joined. Annular ribs 41 protrude outwardly relative to the center of the container and form valleys 44 between the ribs. An outwardly rolled lip or rim 46 is formed along the top edge of the inner sidewall to make the top of the container more rigid.

Looking to FIG. 5, the outer sheet 48 is also preferably made of paper and has two ends 50, a top edge 52, and a bottom edge 54. The outer sheet is configured such that top edge 52 and bottom edge 54 are arcuate and match the arc of scores 40 formed in the inner sheet. In making the laminated blank 23, the perimeter 55 of the outer sheet 48 is pressed against and secured to the surface of the inner sheet 30 above top rib 66, below bottom rib 68 and adjacent the rib ends 64.

Outer sheet 48 preferably includes expansion joints 56 comprised of vertically extending slits 58 cut through the outer sheet. As shown in FIG. 5, the outer sheet preferably includes two spaced apart expansion joints 56 which are located near but on opposite sides of the center of the outer sheet. The slits extend from top edge 52 to bottom edge 54 of the outer sheet. In the alternative the outer sheet may be formed of an expandable elastic material which will expand or stretch upon formation of the container body so as to eliminate the need for the expansion joints.

In a preferred embodiment of the invention shown in FIGS. 1 and 5, the container is a dual wall drinking cup having two expansion joints comprised of four columns of six slits. Each slit is approximately 0.50 inches in length and is spaced from an adjacent slit in the same column by about 0.06 inches. The slits in adjacent columns are staggered so that the slits overlap the spacing between the slits of an adjacent column with spacing between the columns of about 0.06 inches.

To form the container, the outer sheet 48, inner sheet 30, and the bottom piece 26 are fabricated as described above. An adhesive 60, which is schematically shown by dots in FIGS. 1 and 5 is applied between the inner and outer sheets. Preferably, the adhesive is applied only on the perimeter 55 of the outer sheet, but it may be applied over the entire sheet. Most preferably, the adhesive is not applied in the region of the expansion joints. Outer sheet 48 is attached to inner sheet 30 to form laminated blank 23, and in this embodiment, the scores 40 serve as a guide for placement of outer sheet 48. Laminated blank 23 is then fed to a container forming machine (not shown) which simultaneously wraps the ends of blank 23 around a conventional mandrel so that end 36 overlaps end 38. Ends 36 and 38 are then secured in overlapping relationship to form side seam 42 via adhesives or heat sealing means.

As the laminated blank is wrapped around the mandrel, the outer sheet increases in length or stretches due to its outside location. Specifically, the slits in the expansion joints open slightly to allow the length and hence the circumference of the outer sheet to increase. It is possible to form the container without the expansion joints, but when paper is used, which does not stretch, the inner sheet will wrinkle to effectively reduce its diameter. The resulting wrinkled inner sidewall is undesirable for many applications. After the container body is removed from the mandrel, the bottom piece is attached in a conventional manner preferably along bottom edge 34 of inner sheet 30. An upper rim 46 is formed along top 20 of the container by rolling top edge 32 of inner sheet outward and downward as is known in the art. This method of manufacture eliminates the need to produce two separate containers which then must be secured together as is known in the prior art.

Once the container is formed, the outer sidewall overlaps ribs 41 to create air pockets 62 between the inner sidewall 24 and outer sidewall 28. As best shown in FIG. 2, ribs 41 act as standoffs which hold outer sidewall 28 outwardly from inner sidewall 24 and form the insulating air pockets 62. Preferably, ribs 41 are provided along the middle portion of the inner sidewall, and thus, the outer sidewall covers only the middle region of the container. This places the insulation where it is needed most in the middle of the container where it is normally held in the hand of a user. This also avoids using excess material for the outer sidewall.

The annular air pockets 62 extend circumferentially around the container and are closed at either end 64. Each adjacent pair of annular ribs 41 forms an annular air pocket 62 between the inner and outer side walls which provides the container with good insulating properties. Because the air pockets do not extend vertically along the height of the container, the convection currents in the air pockets have far less influence than if the air were allowed to flow over the entire height of the container.

Figure 4:
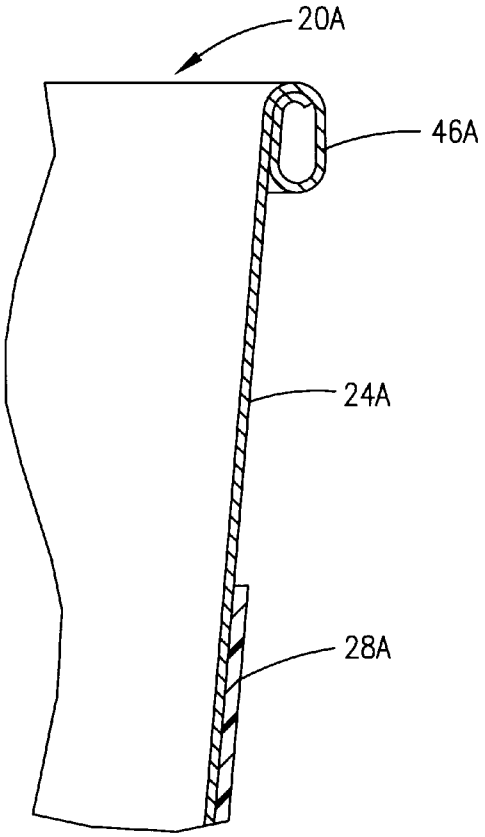
FIG. 4 is an enlarged fragmentary cross-sectional view of the region denoted by numeral 4 in FIG. 3.
Figure 3:
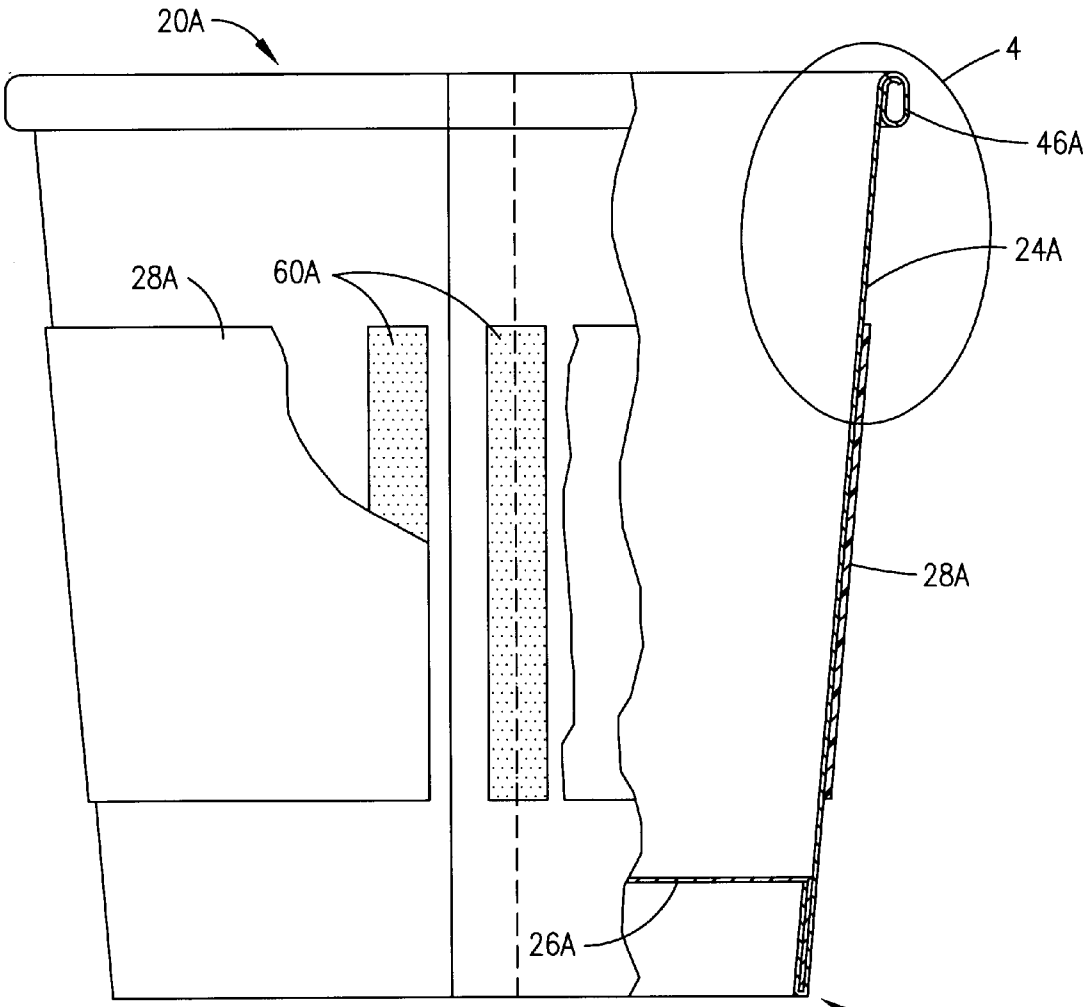
FIG. 3 is an elevational view in partial cross-section of a dual wall insulated container according to the second embodiment of the present invention, having portions of the outer sidewall removed for purposes of illustration.

FIGS. 3, 4, and 6 illustrate a second embodiment of the invention which will be described only to the extent of the differences between the embodiments. The features in common with the above-described container are identified by the same reference numeral with the additional suffix A. This second embodiment omits the scoring of the inner sheet to provide ribs and air pockets for purposes of insulation and instead utilizes a thicker insulating material such as foam. The inner and outer sheets 30A and 48A respectively are therefore positioned in direct contact over the entire area of the outer sheet with an adhesive 60A preferably securing the two sheets together along ends 50A of outer sheet. Outer sheet 48A may include expansion joints 56A with slits 58A to enable expansion of the outer sheet as the container body is formed. Alternatively, outer sheet 48A may be made of an expandable elastic material that will stretch as the container is formed.

From the foregoing it will be seen that this invention is one well adapted to attain all ends and objects hereinabove set forth together with the other advantages which are obvious and which are inherent to the structure.

It will be understood that certain features and subcombinations are of utility and may be employed without reference to other features and subcombinations. This is contemplated by and is within the scope of the claims.

Since many possible embodiments may be made of the invention without departing from the scope thereof, it is to be understood that all matter herein set forth or shown in the accompanying drawings is to be interpreted as illustrative, and not in a limiting sense.

What is claimed is:

1. An insulated container having an innermost sidewall and an outermost sidewall, a longitudinal axis, a body having a side seam and a lip, and a bottom portion, the container comprising:

a frusto-conical shaped inner sheet having a top edge, a bottom edge and two side ends, the side ends secured together in overlapping relationship to form the side seam of the body, and the top edge of the inner sheet being outwardly rolled to define the lip, the inner sheet further having a sidewall height extending between the top edge and the bottom edge of the inner sheet, wherein the inner sheet has a plurality of annular ribs spaced apart along at least a portion of the sidewall height;

a frusto-conical shaped outer sheet having a top edge, a bottom edge and two side ends, the outer sheet being secured to the inner sheet to cover at least a portion thereof, and wherein the two side ends of the outer sheet are spaced apart from the side seam of the body of the container; and a bottom member secured along the bottom edge of the inner sheet to thereby enclose the bottom portion of the container.

2. The container of claim 1, wherein the annular ribs of the inner sheet each have two ends, both of the two ends of each annular rib being spaced apart from the side seam of the body thereby creating a flat gluing portions adjacent each side end of the inner sheet.

3. The container of claim 1, wherein the outer sheet further has a plurality of generally vertical slits therethrough to permit the outer sheet to expand in length during formation of the container.

4. The container of claim 1, wherein the top edge of the outer sheet is spaced apart from the lip.

5. The container of claim 1, wherein the inner sheet defines the innermost sidewall of the container and the outer sheet defines the outermost sidewall of the container.

6. The container of claim 5, wherein the bottom edge of the outer sheet is spaced apart from the bottom member and the bottom edge of the inner sheet wherein a portion of the inner sheet is engagable from an outside of the container by a hand of a user.

7. The container of claim 1, wherein said outer sheet includes expansion joints and wherein the expansion joints enable the outer sheet to expand and increase in circumference as the body is formed.

8. The container of claim 7, wherein the expansion joints include a plurality of generally vertical slots through the outer sheet.

9. An insulated container comprising:

a liquid engaging inner wall having a plurality of outwardly protruding annular ribs spaced apart along a portion thereof;

a user engaging outer wall adhered to the inner wall and covering the annular ribs of the inner wall to form generally horizontal air pockets between the inner and outer walls, and wherein the outer sheet has a plurality of generally vertical slits therethrough to permit the outer sheet to expand in length during formation of the container; and a bottom member secured to the inner wall of the container to thereby close an end of the container.

10. The container of claim 9, wherein the inner wall includes an inner sheet having two opposing end margins secured to each other in overlapping relationship to form a side seam.

11. The container of claim 10, wherein the inner sheet has an upper lip and wherein the outer sheet has a top edge and a bottom edge, the top edge being spaced apart from the lip of the inner sheet wherein a portion of the inner sheet is engagable by a hand of the user on an outer surface thereof between the top edge and the lip, and the bottom edge being spaced apart from the closed end of the container wherein a portion of the of the inner sheet is engagable by a hand of the user on a second outer surface thereof between the bottom edge and the closed end of the container.

12. The container of claim 10, wherein each of the annular ribs are elongate in shape and terminate in two opposing ends, wherein each of the two ends of each of the annular ribs are spaced apart from the side seam, and wherein the overlapping end margins are flat, non-ribbed portions.

13. The container of claim 9, wherein each annular rib is spaced apart from another rib by a flat, non-ribbed portion.

14. An insulated container comprising:

an inner sheet having a top edge, a bottom edge and two end margins, the end margins secured to each other in overlapping relationship, the inner sheet further having a plurality of generally horizontal outwardly protruding ribs on a portion thereof, each rib terminating in two ends, said two ends each spaced apart from said two end margins to provide flat non-ribbed portions at each end margin for having glue applied thereto for the securing of the end margins to each other in the overlapping relationship;

an outer sheet secured to the inner sheet and having a margin extending around a periphery of the outer sheet, the margin providing a flat portion to secure the outer and inner sheets together; and a bottom member secured around the bottom edge of the inner sheet to define a bottom of the container.

15. The container of claim 14, wherein the outer sheet further includes a plurality of slits therethrough, the slits permitting the outer sheet to expand when the container is formed.

16. A laminate blank for forming the body of an insulated container when wrapped about a mandrel, the blank comprising:

a flat first sheet having a curved top edge, a curved bottom edge and two opposing side margins, the first sheet further having a height dimension which extends between the top edge and the bottom edge and having a length dimension which extends between the side margins, the height dimension being substantially constant from one side to the other whereby the first sheet forms an annular section, the first sheet having a plurality of upwardly protruding ridges spaced apart from each other and running along at least a portion of the length dimension, each of the ridges terminating in two ends which are spaced apart from the side margins; and a flat second sheet secured on top of the first sheet and covering the ridges, the second sheet having a curved top edge, a curved bottom edge and two opposing ends, the ends of the second sheet being spaced apart from the side margins of the first sheet.

17. The laminate blank of claim 16, wherein the second sheet further includes a series of slits therethrough to permit the second sheet to lengthen when the laminate is wrapped about the mandrel.

18. The laminate blank of claim 16, wherein the outer sheet further includes a peripheral margin extending around the periphery of the outer sheet, the margin providing a flat portion to secure the outer and inner sheets together, and wherein the outer sheet is adhered to the inner sheet along the peripheral margin.

19. A laminate blank for forming the body of an insulated container when wrapped about a mandrel, the blank comprising:

a flat first sheet having an arcuate top edge and an arcuate bottom edge, the top edge and the bottom edge being concentric arcs, the first sheet further having two opposing side ends, a height dimension extending between the top edge and the bottom edge, and a width dimension extending between the side ends;

a flat second sheet secured to the first sheet and having an arcuate top edge and an arcuate bottom edge, the top and bottom edges of the second sheet being concentric arcs to each other and to the top and bottom edges of the first sheet, the second sheet further having two opposing side ends, a height dimension extending between the top and bottom edges of the second sheet, and a width dimension extending between the side ends of the second sheet; and wherein the height dimension of the second sheet is less than the height dimension of the first sheet whereby the top edge of the second sheet is spaced apart from the top edge of the first sheet and the bottom edge of the second sheet is spaced apart from the bottom edge of the first sheet, and wherein the width dimension of the second sheet is less than the width dimension of the first sheet whereby both of the side ends of the second sheet are spaced apart from the side ends of the first sheet.

20. The laminate blank of claim 19, wherein the first sheet is paper and the second sheet is styrofoam.

* * * * *